United States Patent [19]

Petterson

[11] 4,077,542

[45] Mar. 7, 1978

[54] UNATTENDED AEROSOL DISPENSER

[76] Inventor: Tor H. Petterson, 6768-8 Los Verdes Dr., Rancho Palos Verdes, Calif. 90274

[21] Appl. No.: 631,688

[22] Filed: Nov. 13, 1975

Related U.S. Application Data

[63] Continuation-in-part of Ser. No. 528,855, Dec. 2, 1974, abandoned, Ser. No. 528,857, Dec. 2, 1974, abandoned, and Ser. No. 528,858, Dec. 2, 1974, abandoned.

[51] Int. Cl.[2] ..... B67D 5/08

[52] U.S. Cl. ..... 222/70; 222/402.2

[58] Field of Search ..... 222/402.2, 70, 190, 222/498, 54, 406, 407, 189, 564, 402.22; 239/513, 99

[56] References Cited

U.S. PATENT DOCUMENTS

| | | | |
|---|---|---|---|
| 3,419,189 | 12/1968 | Iketani | 222/54 |
| 3,477,613 | 11/1969 | Mangel | 222/70 |
| 3,658,209 | 4/1972 | Freeman et al. | 222/70 |
| 3,756,472 | 9/1973 | Vos | 222/189 |
| 3,893,597 | 7/1975 | Ewald | 222/402.22 |
| 3,968,905 | 7/1976 | Pelton | 222/70 |

*Primary Examiner*—Stanley H. Tollberg

[57] ABSTRACT

An aerosol dispenser having a labyrinth or tortuous passage flow control body to cause gradual reduction in pressure and effect separation of the product and propellent issuing from an aerosol container into gaseous and liquid components, the components between discharge cycles collecting in an accumulator region containing a snap action diaphram, which in response to a selected pressure, snaps open to discharge a small quantity of product and propellent in predetermined sequence to produce a crisp discharge of the product without initial or residual dribble or trickle. The dispenser may be formed integrally with the container and thus expendable, or the pressure reducing and flow control means may be integral with the container and expendable therewith, the remaining portion of the dispenser being removable for reuse, or the entire dispenser may be arranged for removable attachment to a conventional container. Also, the dispenser may include a manual override. Still further, the dispenser may be arranged to discharge a single phase aerosol in which the propellent is distributed throughout the product, or arranged to discharge a dual phase aerosol, in which the product and propellent exist in a separated state in the container.

43 Claims, 31 Drawing Figures

UNATTENDED AEROSOL DISPENSER

This application is a continuation-in-part of three applications, all of which were filed Dec. 2, 1974; and bear the title UNTENDED AEROSOL VALVES, said applications bearing respectively Ser. Nos. 528,855; 528,857 and 528,858; and have been abandoned due to the filing of this application.

BACKGROUND

The aerosol consumer package goods market has enjoyed excellent growth and profits since the early 1950's. However, recent consumer research has indicated a growing ground swell of negative attitudes towards aerosols in general. Specifically, the consumer is most concerned about:

a. the rising costs of aerosols with diminishing "apparent value",
b. product malfunctioning including valve clogging and/or failure to dispense all of the contents, and
c. overpackaging, i.e. the aerosol form does not contribute to product performance, rather it is viewed as an expensive "convenience".

Therefore, it is not surprising that the growth in certain aerosol categories such as air fresheners and pesticides has started to soften. Particularly noteworthy has been the vulnerability of these categories to non-aerosol new product introductions. Examples include, pesticide strips and solid air fresheners. Consumer research has shown that the success of both of these non-aerosol products was due primarily to the consumer need for a "continuing" or ongoing type of performance as opposed to the fleeting performance of aerosol sprays. This is understandable since many pesticide and odor problems are lingering in nature and require continuous treatment. Such treatment can be annoying and time consuming. The various solid products were designed to respond to the consumer need for continuous long term treatment. These solid products have performance limitations and generally are a compromise in performance in that they are limited to the volitalizing properties of the carrier and the active materials dispensed.

While a large number of intermittent unattended or automatic aerosol dispensers have been the subject of patents; applicant is unaware of a single such device other than those utilizing expensive electrical timers, which has had commercial success. Cost has been a major problem; however, there are multiple problems inherent in the discharging minute quantities of an aerosol borne product. For one thing it is difficult with conventional flow control means, such as needle valves, to attain the sensitivity of adjustment required to deliver extremely small quantities of product. Also it is difficult to reproduce prior adjustment if the stem of the needle valve is moved. Another problem is to discharge at reasonably constant spacing between discharge, particularly if the spacing is measured in hours or days and the total period of operation may be several weeks or months. Another problem is to produce a crisp discharge free of initial or residual low pressure dribble or trickle of the liquid product which would produce spots adjacent the dispenser, or dry in the minute discharge passage and clog further operation.

Also, because of the wide range of products and propellents, and their physical properties, the problem of producing an unattended aerosol dispenser which will meet the requirement of a variety of products and propellent has heretofore not been accomplished; for example, the components of some aerosols are in a single liquid phase in the container; that is, an essentially homogeneous mixture. The components in other types of aerosol products are present in dual fluid phase; that is, the propellent is separated from the product and collects at the top of the container in a gaseous phase, and the product collects at the bottom of the container in a liquid phase for discharge through a dip tube. In the case of single phase aerosols at some stage of discharge a gaseous phase may collect at the top of the container due to pressure drop.

SUMMARY

The present invention overcomes the deficiencies of previous intermittent or unattended aerosol dispensers and is summarized as follows:

A primary object of the present invention is to provide a reliable, simple to operate, low cost unattended aerosol dispenser, capable of operating intermittently with adjustable or preselected prolonged intervals between discharge.

A further object is to provide an intermittent aerosol dispenser which, when activated, produces a crisp or sharp discharge profile of short duration, that is, although the operating period is short, the discharge profile includes an initial gas component discharge, composed principally, if not entirely, of the propellent, followed by a liquid component discharge composed principally of product; and finally a second gas component discharge, also composed principally, if not entirely of the propellent.

A further object is to eliminate by the discharge profile indicated in the preceding object, and drippage or drooling of liquid, this being accomplished by utlizing the initial gas discharge to vaporize any condensed liquid in the flow path, and by utilizing the final gas discharge to vaporize any residual liquid.

A further object is to provide an intermittent aerosol dispenser which incorporates a novelly arranged accumulator region wherein, during the accumulating periods between discharge the aerosol; that is, the combination of product and propellent, is collected in tandem disposed sub-regions for tandem discharge in gas-liquid-gas phases as set forth in preceeding objects.

A further object is to provide an intermittent aerosol dispenser which incorporates a novelly arranged flow control body having elongated labyrinth or tortuous passages which causes the product and propellent to undergo a gradual pressure drop as it passes from the container to the accumulator region resulting in at least partial volatilization of the propellent forming a liquid phase and a gaseous phase which pass into the accumulator region for subsequent discharge.

A further object is to provide an intermittent aerosol dispenser which incorporates a novelly arranged snap action valve means controlling discharge from the accumulator region.

A further object is to provide an intermittent aerosol dispenser as indicated in the previous object wherein one embodiment of the flow control body is in the form of a porous body having a multiplicity of random disposed passageways, whereas another form utilizes elongated substantially uniform passageways.

A further object is to provide an intermittent aerosol dispenser incorporating a novelly arranged manually operated means whereby the time interval between discharge may be adjusted.

A further object is to provide an intermittent aerosol dispenser, an embodiment of which incorporates a novelly arranged means whereby the dispenser may be manually operated without interferring with subsequent automatic operation.

A still further object is to provide an unattended aerosol dispenser which incorporates novel means particularly suited for dual-phase aerosol wherein all or portions of the product and propellent are separately delivered to the receiving end of the dispenser.

DETAILED DESCRIPTION

Figure 1:
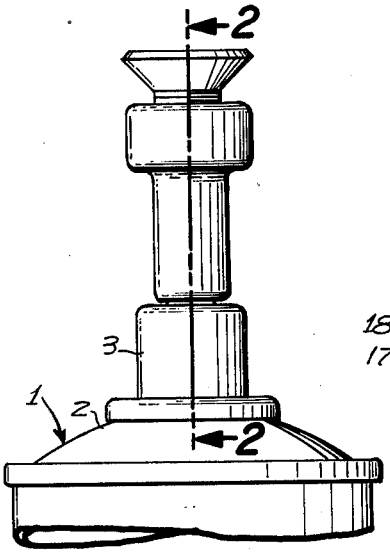
FIG. 1 is a fragmentary view of an aerosol container showing one embodiment of the unattended aerosol dispenser positioned thereon in which a portion is a permanent part of the aerosol container and a portion is removable for reuse.

Referring first to FIGS. 1 through 5. The embodiment of the unattended aerosol dispenser, herein illustrated, is so arranged that a portion of the dispenser is permanently installed on a container and the other portion is removable so as to be used on a series of containers. More particularly, an aerosol container 1 is provided which includes an end enclosure 2 having a sleeve 3 formed of sheet material. The sleeve 3 is circular and receives a lower shell 4 which is essentially cup shaped with a cylindrical wall and receives a porous cylindrical flow control body 5. Below the flow control body 5 there is formed an inlet chamber 6 connected to an inlet stem 7 which in turn is connected to a dip tube 8, extending to the bottom of the container.

The sleeve 3 also receives an upper shell 9 forming a downwardly open cylindrical accumulator chamber 10. A dispenser tube 11 integral with the shell 9 extends downwardly and terminates adjacent but spaced from the upper surface of the flow control body 5. An integral upper mounting stem 12 having a bore **12*a* extends upwardly from the shell 9 and is provided with peripheral retainer ribs 13**.

A valve housing 14 is provided which includes a sleeve 15 adapted to be forced over the mounting stem 12. Interposed between the mounting stem and sleeve is a seal ring 16. The upper portion of the valve housing 14 forms an upwardly directed recess which receives a seal disk 18 formed of elastomeric material provided at its upper side with a central annular valve seat 19 surrounded by axial perforations 20 which connect to a passageway 21 formed in the valve housing and communicating with the bore within the tubular mounting stem 12. The upper side of the seal disk 18 is provided with a peripheral bearing rim 22 which supports the peripheral margin of a snap diaphram valve 23 having a central perforation 24 surrounded by a valve seat portion engageable with the valve seat 19. Fitted over the diaphram valve 23 is a retainer ring 25 having a peripheral bearing rim 26 which engages the periphery of the diaphram valve in opposition to the bearing rim 22. Screwthreaded into the retainer ring 25 is an adjustment screw or actuator 27 having a central nozzle 28 in the form of an outwardly diverging opening. The valve disk 23 and seal disk 18 form therebetween a valve chamber 17.

The term "actuator" as used herein broadly refers to the means employed to actuate the snap diaphram valve. This is accomplished by directly or indirectly initiating flow of product from the container to the snap diaphram valve thereby actuating it. Thus, the actuator can be a screw as adjustment screw 27 in the present embodiment, which actuates the diaphram valve 23 when it unthreaded, permitting the actuator to move.

The accumulator chamber 10, passages 12, 21 and 20, valve chamber 17, are interconnected and form an accumulator region; thus the chambers 10 and 17 form accumulator sub-regions.

Figure 2:
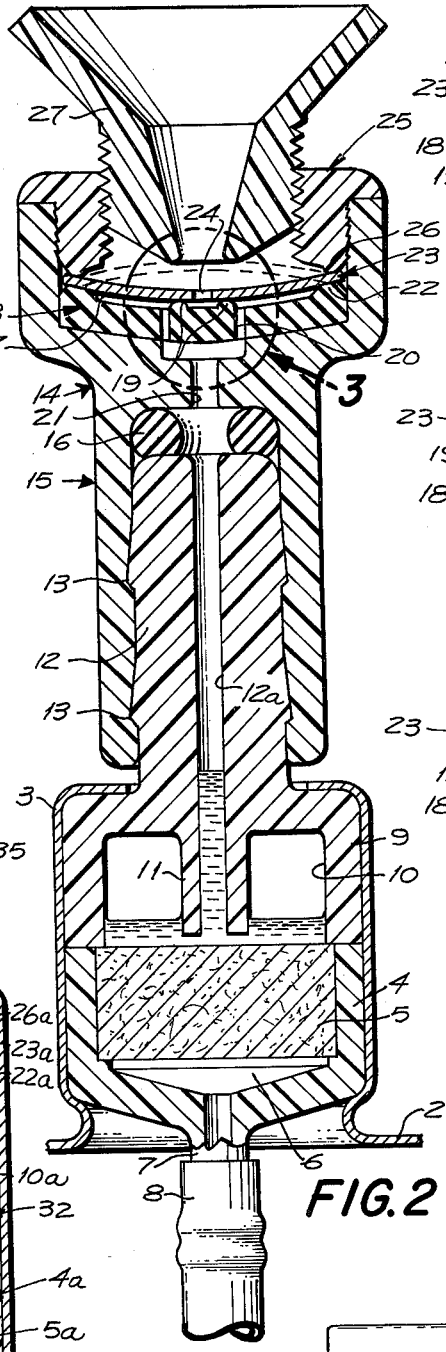
FIG. 2 is an enlarged longitudinal sectional view thereof taken through 2—2 of FIG. 1 showing the control valve in its closed position during accumulation of pressure in the dispenser.

When the unattended aerosol dispenser is not in use, a sealing cap, not shown, is placed over the tubular mounting stem 12. When the cap is removed some discharge will occur, but the rate of flow is limited by the flow control 5 so that a minimal amount is lost and this loss is terminated when the valve housing 14 is placed over the stem, as shown in FIG. 2.

Figure 3:
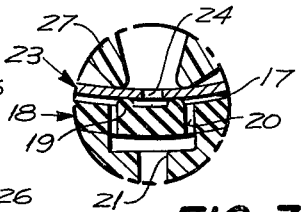
FIG. 3 is a fragmentary sectional view thereof taken within circle 3 of FIG. 2 showing the dispenser valve in its closed position when not in use.

When the housing 14 is fitted on the stem, the adjustment screw 27 is in its lower position, as shown in FIG. 3, in which the snap valve 23 is held against the valve seat 19, preventing a discharge. To place the dispenser in use, the adjustment screw 27 is unscrewed to the position shown in FIG. 2. Initially the pressure in the accumulator region including the chamber 10 and the underside of the snap valve 23 is at atmospheric pressure.

As it will be later discussed in more detail, the flow control body 5 may take various forms. The body may be formed of sintered metal or open pore plastic material or of fiberous material, that is, any material which will provide a multiplicity of labyrinth passages, the minimum length of which is adequate to assure that the product and the propellent will pass through the flow control body at a rate which will determine the period between operations which can vary from several minutes or less to several hours or more. The volume of the accumulator region is small, for example, usually less than a cubic centimeter.

Figure 4:
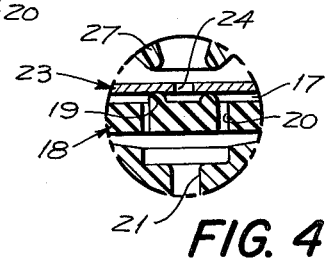
FIG. 4 corresponds to FIG. 3 showing the dispenser valve immediately before it snaps to open position.
Figure 5:
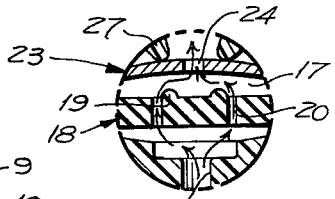
FIG. 5 is a similar view corresponding to FIGS. 3 and 4, showing the control valve upon snapping to open position.

The pressure in the accumulator region slowly builds up under the diaphram valve 23 causing the valve to move to a flat position as shown in FIG. 4. During the movement the seal disk 18 which is formed of elastomeric material follows the diaphram valve until the diaphram moves past center, then aided by the pressure thereunder, the diaphram snaps to the position as shown in FIG. 5, suddenly opening the central perforation 24 for discharge of product and propellent through the nozzle 28.

It will thus be observed that by varying the volume of the accumulator region and the rate of flow in the accumulator region, the following conditions are possible:

1. Low volume discharge — frequent intervals.
2. Low volume discharge — infrequent intervals.
3. High volume discharge — frequent intervals.
4. High volume discharge — infrequent intervals.

The gradual reduction of pressure as the product and propellent mixture flows through the porous flow control body 5 results in some separation of the product and propellent, and also causes the propellent, if initially in liquid state, to be at least partially transformed into its gaseous state, particularly during initial accumulation at low pressure. As a consequence the liquid product accumulates in the lower portion of the accumulator sub-region 10 covering the lower end of the depending tube 11, as shown in FIG. 2. The liquid also extends part way into the tube 11.

When the valve suddenly snaps from its closed position, as shown in FIG. 4, to its open position, as shown in FIG. 5, there is a short and rapid initial discharge of pressurized gaseous propellent which has collected in the accumulator sub-region 17 which vaporizes any predeposit of liquid product. This initial discharge produces a pressure drop in the accumulator sub-region 10, which causes the gaseous propellent trapped in the upper portion of the accumulator sub-region 10 to drive the liquid form the sub-region 10 through the passageways into the sub-region 11 and through the discharge port 24. As the pressure drops, liquid propellent remaining in the product expands and drives the product through the nozzle 28, finally the gaseous propellent originally surrounding the depending tube 11 discharges and forces any residual product from the nozzle 28. During such discharge, the pressure under the diaphram valve is reduced to a point that the diaphram snaps back to its normal position, as shown in FIG. 2.

Figure 13:
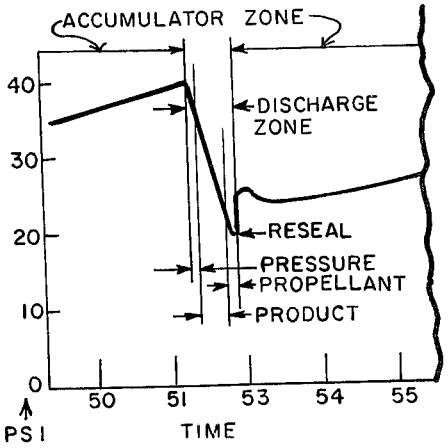
FIG. 13 is a fragmentary graphic representation indicating the pressure change within the dispenser as it approaches the snap action pressure and the pressure at the start of accumulation.

Referring to FIG. 13, which is a typical graph illustrating an approximately 10 minute cycle of operation including alternately an Accumulating Zone and a Discharge Zone in which the valve snaps open at approximately 40 p.s.i. and reseals at approximately 20 p.s.i., the duration of the Discharge Zone being less than 30 seconds.

It will be seen that once the pressure under the diaphram valve has reached a predetermined level, indicated as 40 p.s.i., sudden opening of the valve causes a rapid decrease in pressure in the accumulator region and causes an initial and final discharge of gaseous propellent with an intermediate discharge of product, which may contain some additional propellent.

While a 10 minute cycle is indicated, in the graph the Accumulating Zone between Discharge Zonés may be preselected to occur at a shorter time interval than 10 minutes or a substantially longer time cycle such as several hours, depending on the nature of the product and its purpose. Also the volume which is discharged is predetermined by the selected size of the accumulator region.

It should be noted that for purposes of illustration, the thickness of the diaphram is exaggerated. By way of example, but not limitation, the optimum thickness of the diaphram valve, if made of stainless steel, may be in the order of 0.008 in. (0.20mm).

The diameter of the diaphram valve may be in the order of $\frac{3}{4}$ in. (0.19mm) and the full length of travel between the dotted line position and the solid line position shown in FIG. 2, may be in the order of 0.020 in. (0.50mm).

The adjustment screw or actuator 27 may be provided with fine threads so that the distance traveled by the diaphram valve when it snaps past center, may be adjusted. By way of example, but not limitation, the diaphram valve may be arranged to snap open at 40 pounds pressure if it snaps full open the pressure under the diaphram may drop to 20 pounds before the diaphram snaps back to its original position, shown by solid lines in FIG. 2. If the adjustment screw 27 is moved downward to a point just beyond the point at which the diaphram tends to snap open the diaphram valve may snap closed when the pressure drops from 40 pounds to 38 pounds. It will be seen that if the diaphram valve moves to its full open position the valve opening will be maximum permitting maximum discharge of the propellent and the product, however, in order to provide operation for an adequate period of use maximum discharge represents a small volume of the pressurized fluid. When the diaphram valve is adjusted for minimum travel the discharge is substantially lower. Also, when set for maximum discharge rate, the period between discharges is materially increased due to the fact that, for example, the pressure rises from 20 pounds to 40 pounds, whereas under conditions of minimum discharge rate, the period between discharges is also minimum, as the pressure need rises from only about 38 to 40 pounds.

Figure 6:
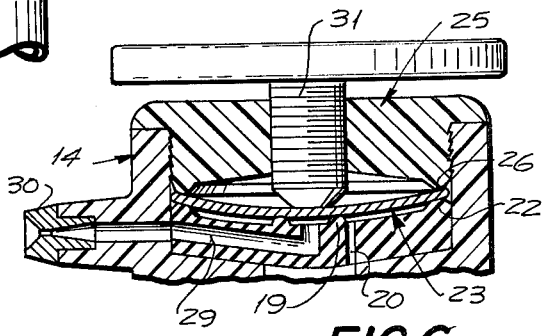
FIG. 6 is a fragmentary sectional view showing a modification of the embodiment shown in FIG. 2 wherein the dispenser is provided with a lateral nozzle rather than an axial nozzle.

Referring to FIG. 6, if it is desired to direct the contents of the container radially rather than axially, the seal disk 18 may be provided with a radial passage 29 having an entrance within the central annular valve seat 19. The housing 14 is provided with a radial nozzle 30, the central perforation 24 is omitted from the diaphram valve and a solid screwthreaded adjustment screw 31 is provided.

Figure 7:
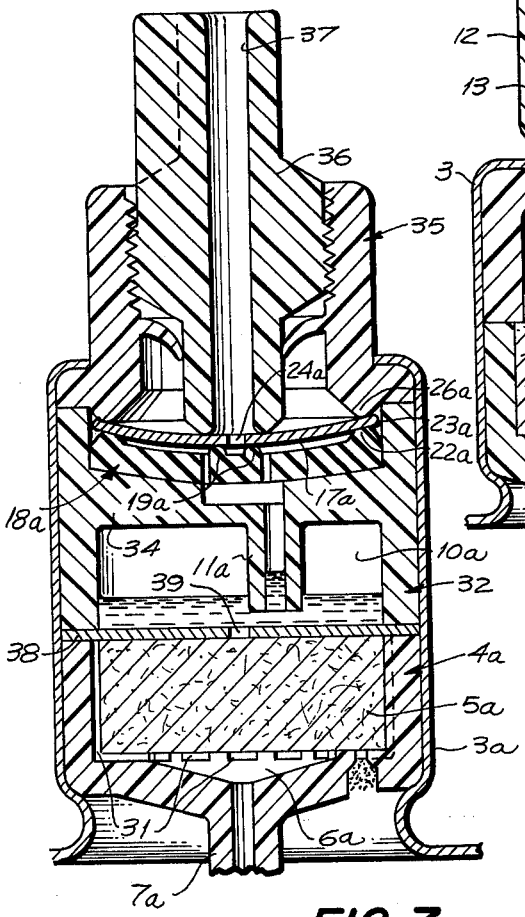
FIG. 7 is a longitudinal sectional view showing another embodiment of the unattended aerosol dispenser, in which the entire dispenser assembly is secured in the end of an aerosol container.

The construction shown in FIGS. 1 through 6 enables the flow control body to be made of reduced size as it needs to function only during the discharge from a single container and the total flow therethrough is limited. The timing and flow control body need not be expendable, but may be used repeatedly on a series of aerosol containers. However, as illustrated in FIG. 7 the entire dispenser may be arranged as a single unit, thus in FIG. 7 (wherein similar parts are given similar numerals followed by the letter "*a*"), the entire dispenser is contained within the sleeve 3*a* and includes a lower shell 4*a* which may be identical to the shell 4, but is shown as provided with channels 31 to expose a maximum proportion of the surface of the flow control body 5*a* to the contents of the aerosol container. Disposed above the lower shell 4*a* is an upper shell 32 which combines the functions of the upper shell 9 and the valve housing 14, that is, the lower portion of the upper shell 32 is provided with a downwardly open accumulator chamber or sub-region 10*a* having a depending tube 11*a*. The upper portion of the upper shell 32 forms an upwardly facing recess separated from the accumulator chamber 10*a* by a partition 34.

The recess above the partition 34 receives a seal disk 18*a* and a diaphram valve 23*a* which forms with the disk 18*a* valve chamber accumulator sub-region 17*a*. Overlying the upper end of the upper shell 33 is a retainer ring 35 having a peripheral bearing rim 26*a*. The retainer ring 35 is internally screwthreaded to receive an adjustment screw 36 having a nozzle bore 37.

While the upper surface of the flow control body 5*a* may be exposed to the accumulator sub-region 10*a* as in FIG. 2, a cover disk 38 is interposed between the lower shell 4*a* and the upper shell 33. The cover disk 38 is provided with a central perforation 39. Also the depending tube 11*a* is offset with respect to the perforation 39.

The embodiment shown in FIG. 7 operates in the manner described and relative to FIG. 2, however, the time interval between operations is materially increased by the presence of the cover disk 38, exposing only a small portion of the upper surface of the flow control body 5*a*.

Figure 22:
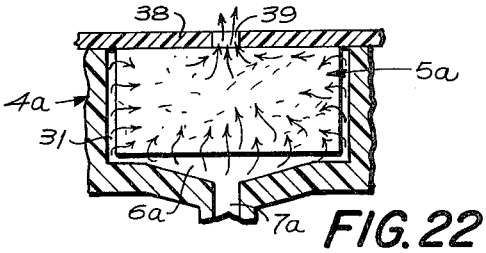
FIGS. 22 through 25 are diagrammatical views of one form of flow control means under different conditions of use.

The functioning of the flow control body and cover disk is more fully shown in FIG. 22. The confronting surfaces of the porous body 5*a* and disk 38 may be provided with a sealant except for the area of the body 5*a* underlying the perforation 39. Or a soft gasket, not shown may be used. As represented by the arrows, the number of labyrinth passage inlets is greater than the number of labyrinth passage outlets exposed to the perforation 39.

If the porosity of the body 5*a* is uniform, the ratio of inlets to outlets corresponds to the ratio between the area exposed to the container and the area exposed to the perforation 39. As the product and propellent pass through the porous body, the pressure is gradually reduced resulting in the propellent at least partially vaporizing, so that both a gaseous phase and a liquid phase pass through the perforation 39 into the accumulator chamber 10*a*. The rate of flow may be extremely small. In spite of the extremely slow flow rate, tests have indicated that because of the extremely large number of passages which first receive the aerosol, the chance of clogging at the exit ends of the passages is virtually zero, even though the average passage chamber may be virtually microscopic; that is, typically the passages have a path length to pore diameter ratio in the order of 1000 to 1 or more. The preferred proportion of axial depth to diameter of the porous body is 1 to 2.

As the dispenser is intended for use with a wide range of aerosols, some aerosol mixtures may not provide enough gaseous propellent for a final flushing of the liquid propellent with a gaseous discharge. This condition may be overcome by introducing a portion of the propellent directly into the flow control body 5*a*. This may be accomplished by one or more vapor taps, 40 which may be formed in the lower wall of the lower shell 4*a*. The entrance end of the vapor tap is exposed directly to the propellent in the upper end of the container and the discharge end of the vapor tap is directed into the flow control body 5*a*. The vapor tap may be open or provided with a porous plug 41.

Figure 25:
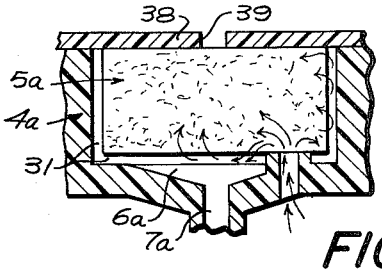
Figure 28:
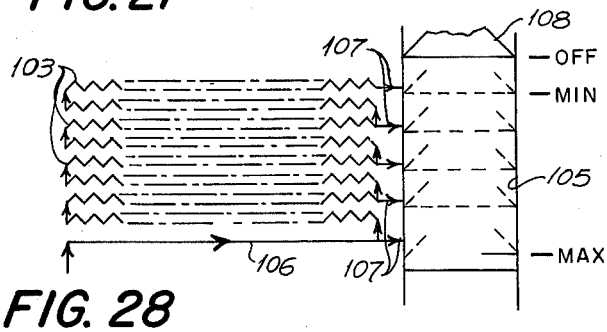
FIG. 28 is a diagrammatical view showing the manner in which the effective length of labyrinth passage may be varied to vary the rate of accumulation of fluid passing through the flow control means.

The function of the vapor tap is best illustrated in FIG. 25. The porous body 5*a* closes the vapor tap 40 causing the vaporized propellent to enter the porous body. Once entered, some of the propellent is carried by the product and propellent entering through the dip tube 7*a*; however, some vaporized propellent re-enters the channels 31, then re-enters the flow control body 5*a*. The result is an increase in a gaseous component. If a porous plug 41 is used, it serves to reduce flow. Also, in some cases, if the plug 41 is used, the vapor tap need not contact the flow control body.

Figure 9:
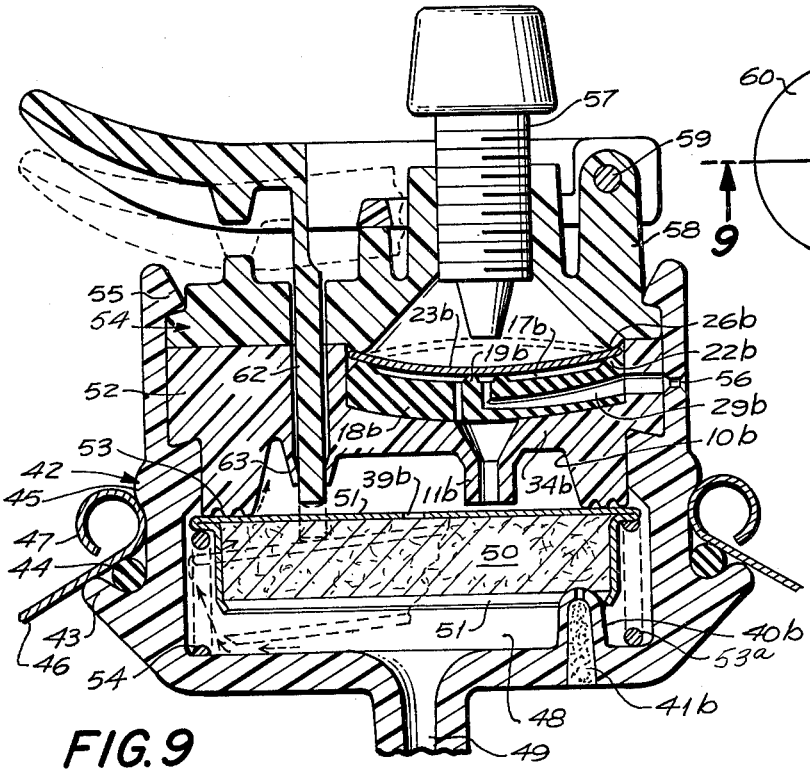
FIG. 9 is an enlarged transverse sectional view thereof, taken through 9—9 of FIG. 8, and showing the dispenser installed in an aerosol can.
Figure 8:
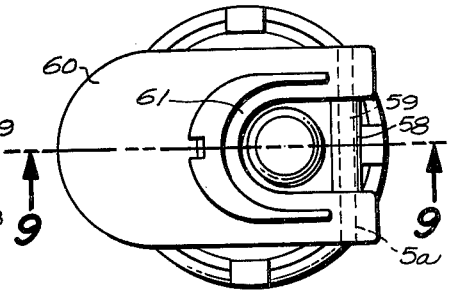
FIG. 8 is a plan view of a further embodiment of the unattended aerosol dispenser which is provided with a manual override.

Referring to FIGS. 8 and 9, these figures illustrate an embodiment of the aerosol dispenser which is capable of manual operation as well as unattended automatic operation. This embodiment of the dispenser includes a housing 42 having an external flange 43 and a seal ring 44. An annular retainer rib 45 is spaced axially from the flange 43. The container is provided with an end cap 46 forming an opening having a rolled margin 47, dimensioned to receive the housing by insertion of the housing within the end cap and forcing the retainer rib 45 past the rolled margin 47 of the end cap.

The housing 42 is provided with an upwardly open chamber 48 having a central downwardly extending inlet 49 for connection to the dip tube, not shown. Received in the chamber 48 is a flow control body 50 which is encased, except at its lower side, in a shell 51. The housing 42 receives a partition member 52 which forms an annular seat 53. A spring **53*a* urges the shell 51 against the seat 53**.

Within the annular seat 53 the partition member forms a downwardly open accumulator chamber or sub-region **10*b*, the shell 51 is provided with a central perforation 39*b*. The upper side of the partition member receives an upwardly facing seal disk 18*b* underlying a diaphram valve 23*b* and forming therewith a valve chamber or accumulator sub-region 17*b* separated from the accumulator chamber 10*b* or sub-region by a partition 34*b*. A depending tube 11*b* extends into the accumulator chamber 10*b*. The body member 52 is covered by a cap 54 which is secured to the body member by retainer clips 55**.

As in the other embodiments, the seal disk **18*b* is of elastomeric material having a peripheral bearing rim 22*b* opposed by a bearing rim 26*b* provided at the under side of the cap 54. The diaphram valve 23*b* is retained between bearing rim 22*b* and 26*b*. The diaphram valve is provided with a central perforation 2. The seal disk is provided with a valve seat ring 19*b* for sealing the perforation. The seal disk 18*b* is provided with a radial passage 29*b* which communicates with a laterally directed nozzle 56. The cap member 54 is provided with an adjustment screw actuator 57**.

Extending upwardly from one side of the cap 54 is a mounting lug 58 having a journal pin 59 to which is attached a handle lever 60 which extends horizontally over the cap member and has a clearance opening for the adjustment screw 57. Within the opening there is provided an integral U-shape spring 61, which bears against the cap 54 to urge the extended end of the handle lever 60 in an upward direction. Extending downward from the handle lever is a pin 62 which extends through a seal lip 63 into the accumulator chamber **10*b*** as one side thereof.

The operation of the unattended aerosol dispenser, as shown in FIGS. 8 and 9, is the same as the previously described embodiment. When it is desired to operate the dispenser manually, the handle lever is pressed downward, causing the pin 62 to engage the shell 51 forcing the shell away from the seat 53 so that the product and propellent may bypass the flow control body.

Figure 10:
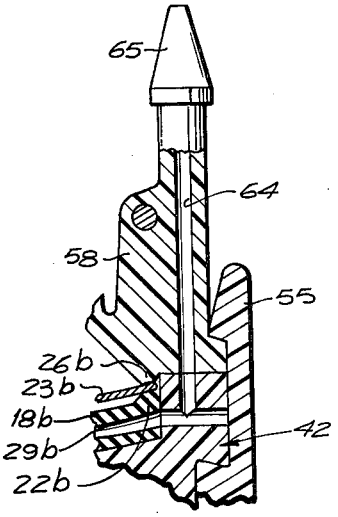
FIG. 10 is a fragmentary sectional view showing a modification of the embodiment shown in FIGS. 8 and 9 wherein the dispenser is provided with an axially directed nozzle.

Referring to FIG. 10, if it is desired to direct the discharge in an axial direction, rather than in a radial direction, the mounting lug 58 may be modified to provide an axially directed bore 64 communicating with the radial passage **29*b* and provided with a nozzle 65**.

If the nature of the product requires a vapor tap **40*b*, it may extend upwardly from the base of the housing 42 into engagement with the flow control body 50. The vapor tap may be located at the margin of the flow control body opposite from the pin 62 so that the shell 51 and flow control body 50 may be pivoted the slight amount required to permit the product and propellent to bypass. Also the vapor tap 40*b* may be provided with a porous plug 41*b***.

Figure 11:
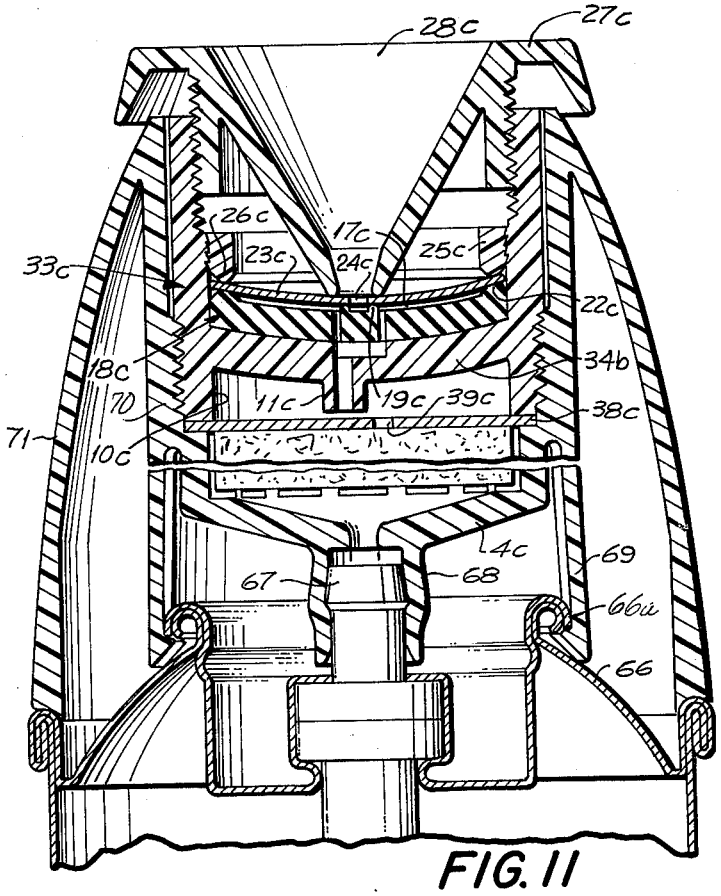
FIG. 11 is a longitudinal sectional view of a further embodiment of the unattended aerosol dispenser, which is arranged as a single unit for removable attachment to an aerosol can.

Referring to FIG. 11, this embodiment while containing essentially the same dispensing features of the embodiments shown in FIGS. 2 and 7, is arranged for removable installation on an otherwise essentially conventional aerosol container. More specifically, the container includes a cap 66 which carries an outlet stem 67 urged out by internal pressure to an extended closed position and capable of being depressed to an open position.

This embodiment of the dispenser includes a lower shell **4*c* having an inlet sleeve 68 dimensioned to be forced over the stem 67 and form a sealed connection therewith. Retainer fingers 69 extend from the shell 4*c* and hook over a flange 66*a* forming a part of the container cap so that the valve within the outlet stem 67** is maintained in an open position.

The lower shell **4*c* receives a flow control body 5*c* which may be uncovered as shown in FIG. 2 or provided with a cover disk 36*b*, such as shown in FIG. 7. Joined to the lower shell 4*c* by a screwthread connection 70 is an upper shell 33*c*. The upper shell includes a partition 34*c* overlying an accumulator chamber 10*c* receiving a seal disk 18*c*. The partition 34*c* and seal disk 18*c* are provided with a passage which includes a depending tube 11*c* projecting into the accumulator chamber 10*c***.

The seal disk **18*c* underlies a diaphram valve 23*c* and forms therewith a valve chamber 17*c*. The seal disk 18*c* is provided with a peripheral bearing rim 22*c* which supports the diaphram valve 23*c*, having a central perforation 24*c*. The valve is held in place by a retainer ring 25*c* having a bearing rim 26*c*. As in the other embodiments the seal disk 18*c* is provided with a central annular valve seat 19*c*. The upper portion of the upper shell 33*c* receives an adjustment screw or actuator 27*c* having a nozzle 28*c*. The actuation of the diaphram valve in this embodiment can be accomplished by either depressing the stem 67 so as to open the container valve, or by adjusting screw actuator 27*c***.

Extending downwardly from the extremity of the upper shell **33*c* is an enclosure sleeve 71 which bears against the rim of the container cap 66**.

Except for the manner in which the dispenser is mounted on the container, the internal construction and mode of operation is the same as described in connection with the preceeding embodiments.

Figure 14:
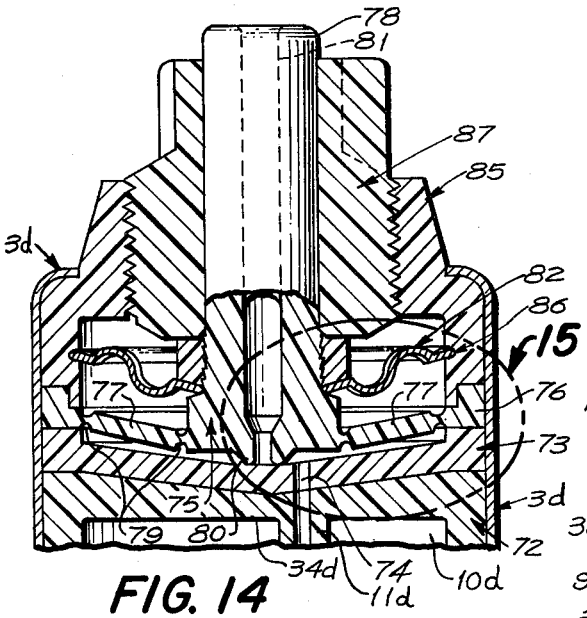
FIG. 14 is a fragmentary sectional view corresponding to FIG. 7 showing a further embodiment of the snap action means, which is shown in its closed position.
Figure 15:
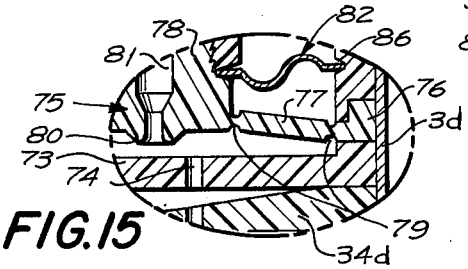
FIG. 15 is a fragmentary sectional view thereof taken within circle 15 of FIG. 14 showing the snap action means in its open position.

Referring to FIGS. 14 and 15, the embodiment herein illustrated involves a flexible diaphram valve which is backed by a snap action spring and which may be substituted for the snap action valve shown in the other embodiments. More particularly this embodiment is shown as mounted in a sleeve **3*d* which receives a shell 72 having a partition wall 34*d* and forming a downwardly directed accumulator chamber 10*d*, having a depending tubular stem 11*d*. Positioned above the shell 72 is a seal disk 73 having a perforation 74** communicating with the tubular stem lid.

Positioned above the seal disk 73 is a flexible valve member 75 having a peripheral rim 76 joined at its radially inward side to a diaphram 77, the central portion of which is joined to a valve stem 78. Grooves 79 are provided to permit axial movement of the valve stem. The valve member is provided with a central valve seat 80 communicating with a nozzle bore 81.

Figure 16:
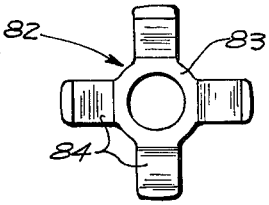
FIG. 16 is a plan view of the snap action spring member as used in FIGS. 14 and 15.
Figure 26:
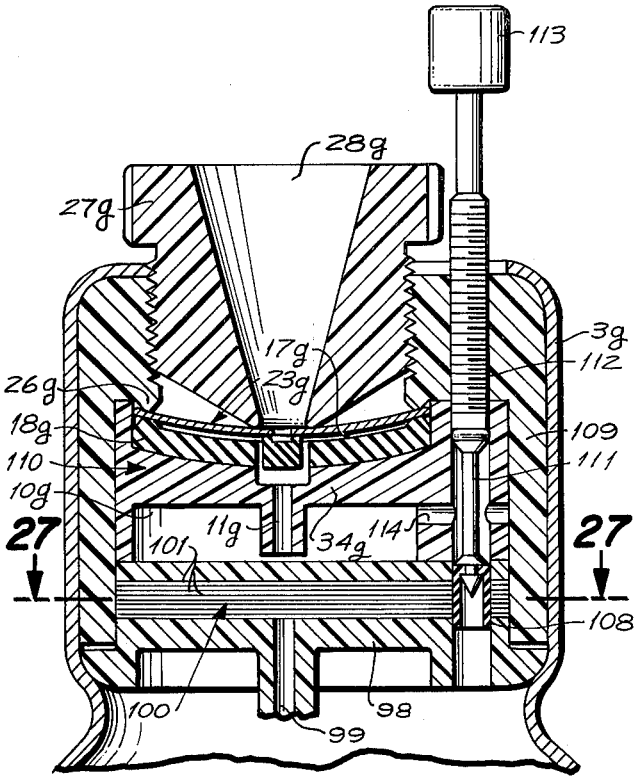
FIG. 26 is a longitudinal sectional view showing a further embodiment of the unattended aerosol dispenser, utilizing labyrinth passages in the flow control means and also providing means for adjusting the accumulation time between discharges.

Above the diaphram 77 the valve stem is provided with an annular groove which receives a spring element 82 comprising an inner ring 83 having radiating spring arms 84 as shown in FIG. 16. Mounted above the rim 76 of the valve member 75 is an end shell 85 having an internal retainer groove 86 into which the extremities of the spring arms extend. Slidably fitting, the valve stem 78 and screwthreaded within the end shell 85 is an adjustment screw or actuator 87. The diaphram 77 and seal disk 73 form therebetween a valve chamber 17*d* forming with the accumulator chamber 10*d* and intercommunicating passageways an accumulator region.

The seal disk 73 functions in the same manner as the seal disk 18, in that during initial travel of the valve member the seal disk maintains sealing contact. The spring need not be an over centered type, for as the spring arms move towards a horizontal position, the force required to move the spring becomes less, so that a point is reached in which snap action occurs, causing discharge of the propellent and product as previously described. Adjustment of the screw 87 determines at what reduced internal pressure the effect of the pressure is overcome by the springs and the cycle repeats.

Figure 17:
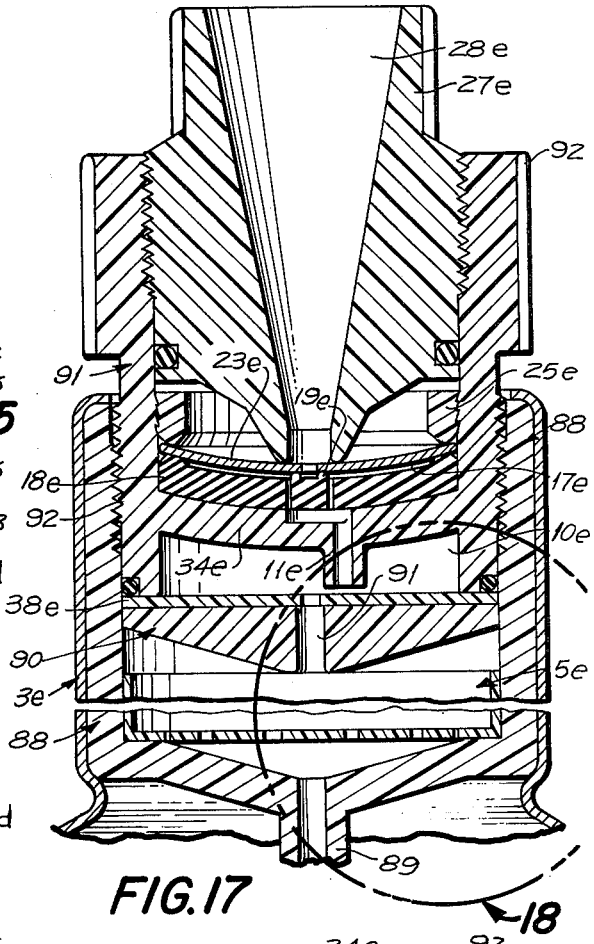
FIG. 17 is a longitudinal sectional view showing a further embodiment of the unattended aerosol dispenser in which means is provided for changing the length of time between operations of the dispenser.
Figure 18:
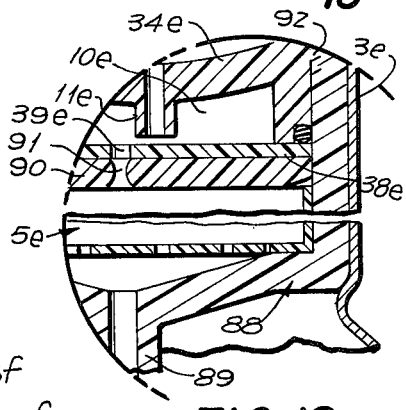
FIG. 18 is a fragmentary sectional view thereof taken within circle 18 of FIG. 17.

Referring to FIGS. 17 and 18, this construction is especially arranged to provide control over the time interval between discharge. The dispenser is shown as arranged for reception in a sleeve 3*e* and includes a cup shape shell 88 having cylindrical walls and the bottom provided with an inlet tube 89. Mounted in the bottom of the shell 88 is a flow control body 5*e*. In this embodiment the upper side of the flow control body 5*e* is covered by an area altering disk 90 having a central perforation 91, above the area altering disk there is a cover disk 38*e*. Received in the shell 88 is a valve body 91 joined to the shell 88 by a screwthreaded connection 92. The valve body 91 is in many respects similar to the upper shell 33 as shown in FIG. 7, and thus, includes a partition 34*e* which separates an accumulator chamber 10*e* and a valve chamber 17*e* formed between the seal disk 18*e* and a diaphram valve 23*e*. A passageway extends between the two chambers which includes a depending tube 11*e*. The seal disk 18*e* is provided with a central annular valve seat 19*e* and a peripheral bearing rim 22*e* which engages the underside of the diaphram valve 23*e*. Above the valve 23*e* is a retainer ring 25*e* having a bearing rim 26*e*. The valve body 91 projects above the shell 88 and forms externally a circular handle 93 so that the valve body may be advanced or retracted with respect to the shell 88. Above the diaphram valve 23*e* is an adjustment screw 27*e* having a nozzle bore 28*e*.

Figure 23:
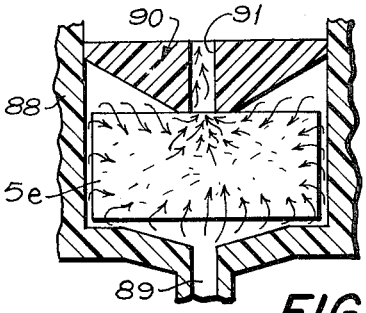
Figure 24:
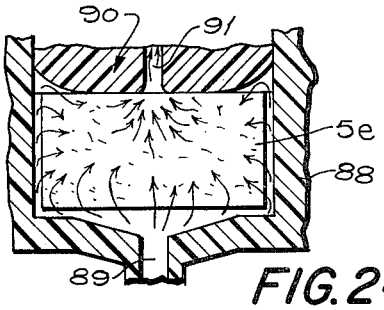

Referring to FIGS. 23 and 24 which correspond respectively to FIGS. 17 and 18, it will be noted that virtually the entire surface of the flow control body may be exposed to the fluid received from the aerosol container. The only exceptions are the ribs which space the flow control body and the apex of the area altering disk 90. Under this condition the rate of flow would be maximum. As the area altering disk 90 is pressed downward, its area of contact increases as indicated in FIGS. 18 and 24, increasing the length of travel required of fluid moving through the flow control body, thereby increasing the time required for pressure to build up in the accumulator chamber.

Figure 19:
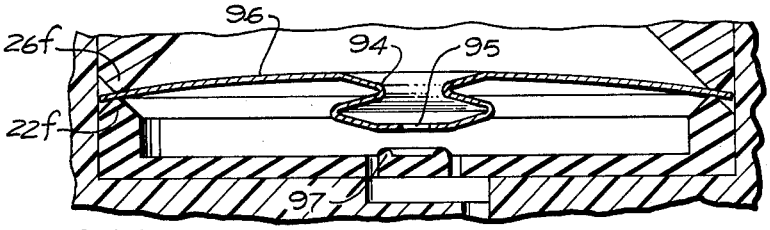
FIG. 19 is an enlarged sectional view showing a modified form of snap action valve and indicating adjacent portions of the dispenser, the valve being shown in its open position.
Figure 20:
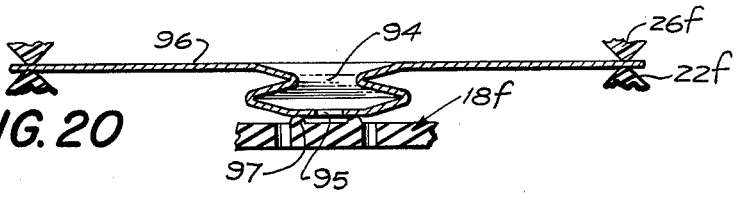
FIG. 20 is a similar view showing the valve immediately prior to snapping to its open position.
Figure 21:
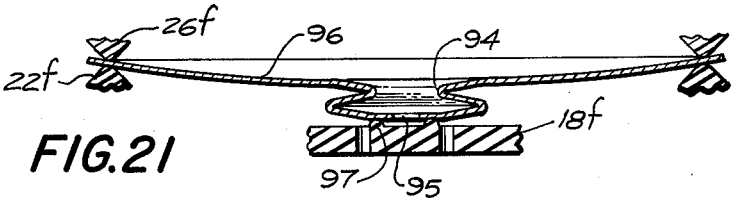
FIG. 21 is another view showing the valve in its closed position when the pressure in the accumulator chamber is at minimum value.

Referring to FIGS. 19, 20 and 21, these figures illustrate an embodiment of the diaphram valve which provides for travel compensation and is an alternative to the seal disk 18. This valve includes central bellows diaphram 94 having a central perforation 95, if needed. The central bellows diaphram is joined to a perhiperal snap action diaphram 96 supported in the manner of the diaphram valve 23, between bearing rims 22*f* and 26*f*. Confronting the bellows diaphram 94 is a fixed valve seat 97.

As shown in FIG. 21, the snap action diaphram 96 is biased to compress the bellows diaphram 94 axially; then as the pressure increases against the peripheral snap action diaphram the bellows diaphram 94 remains in contact with the valve seat as shown in FIG. 20, as snap action occurs, as shown in FIG. 19, the valve is open. It should be noted that the exposed area of the central bellows diaphram is quite small so that the surrounding pressure has minimal effect in changing the axial length of the central bellows diaphram.

Figure 29:
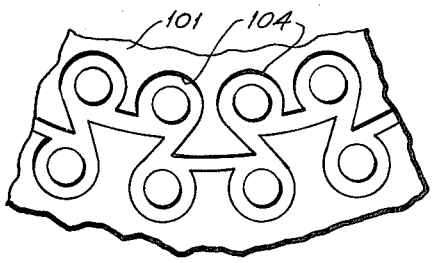
FIG. 29 is a fragmentary view of a turbulance maze which may be utilized as the labyrinth passage in the flow control means.

Referring to FIGS. 26, 27, 28 and 29, this embodiment is directed to a construction in which a series of labyrinith laminations are substituted for the random porous construction of the flow control body 5. More particularly, this construction is also shown as contained in the sleeve 3*g* and includes a bottom plate 98 having a central inlet 99, communicating with the interior of the aerosol container. Mounted on the bottom plate is a flow control body 100 comprising a stack of labyrinth laminations 101. The labyrinth may take various forms, for example, they may be in the form of spiral passageways 103, indicated diagrammatically in FIG. 27 or may include opposing vortices 104, as shown in FIG. 29, which produce a coanda effect. Extending through the flow control body 100 is an eccentric axial bore 105. On the underside of the flow control body is a radial inlet passage 106 dimensioned substantially larger than the labyrinth passages and extending to the axial bore to provide maximum flow. The labyrinth laminations are provided with a series of shorting passages 107 which also intersect the bore 105, mounted in the bore is a plunger 108 which, when moved axially downward in the bore from the position shown in solid lines, opens the shorting passages 107 in sequence to increase the flow into the bore 105.

Extending upwardly from the bottom plate 98 is a shell 109 having a valve body 110 therein which includes a partition 34*g* disposed above a downwardly directed accumulator chamber 10*g* underlying a seal disk 18*g* and diaphram valve 23*g* forming therebetween. As in the other embodiments the accumulator chamber 10*g* is provided with a depending tube 11*g*, the bore of which indicates through a seal disk 18*g* with the valve chamber 17*g* and is provided with a bearing rim which supports the diaphram valve 23*g*. The upper portion of the shell 109 is constricted and is provided with an opposing diaphram valve bearing rim 26*g*. Above the diaphram valve the shell 109 receives an adjustment screw 27*g* having a nozzle bore 28*g*.

The eccentric axial bore 105 extends upwardly through the valve body 110 and the upper portion of the shell 109. The plunger 108 is connected to a stem 111 which includes a screwthreaded portion 112 protruding above the shell 109 and provided with a knob 113. A radial bore 114 communicates between the accumulator chamber 10*g* and the eccentric bore 105.

Operation of this embodiment insofar as the action of the diaphram valve 23*g* is concerned, is the same as previously described. The plunger 108 performs several functions. In its upper position shown in FIG. 26, it forms a complete seal closing off all flow into the accumulator chamber. When the upper end of the plunger 108 exposes the first shorting passage 107, as indicated by broken lines in FIG. 28, the rate of flow into the accumulator chamber is at the minimum rate and as the plunger is lowered further the rate of flow increases with decrease in length of the labyrinth passageways until finally the inlet passage 106 is open for a maximum flow. If desired, such maximum flow could be continuous, thus overriding the automatic intermittent action.

Figure 30:
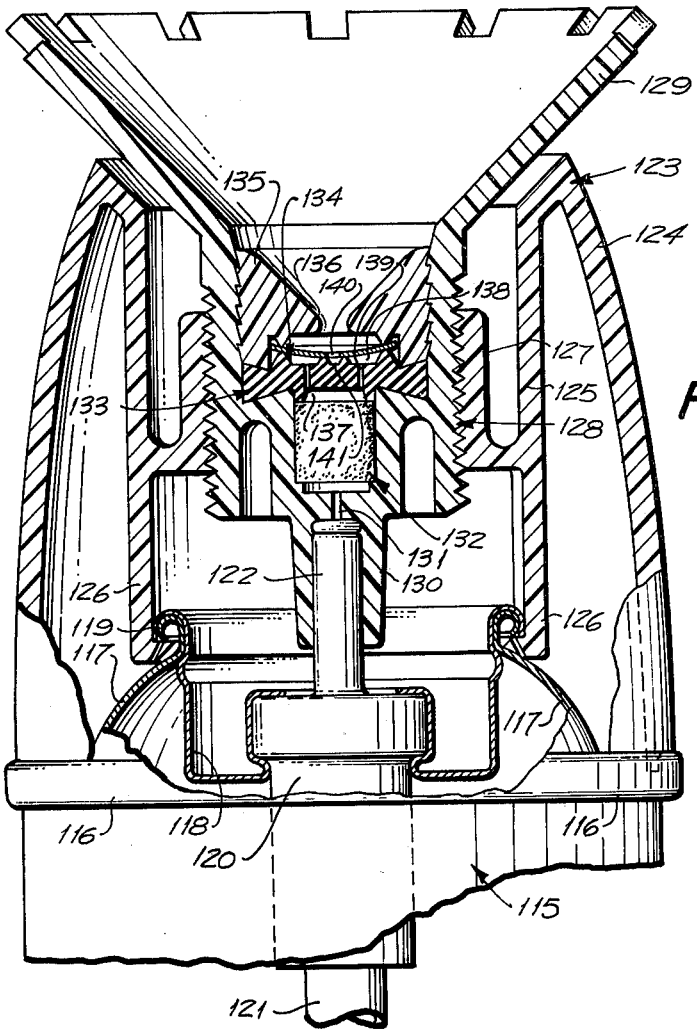
FIG. 30 is a fragmentary longitudinal sectional view showing a further embodiment of the unattended aerosol dispenser.

Referring to FIG. 30, the embodiment here illustrated is mounted on a conventional aerosol container 115 having an outer rim 116 to which is attached a peripheral end member 117. Within the peripheral end member 117 is a central end member 118 which is recessed, end members 117 and 118 are joined by an inner rim 119. Within the central end member 118 is a conventional outlet valve 120 connected internally to a dip tube 121 extending within the container 115. The outlet valve also includes an exposed axially extending stem 122 which is axially movable between an extended position closing the outlet valve and a retracted position opening the valve. The structure thus far described is conventional.

The embodiment shown in FIG. 30 includes a dispenser housing 123 having an encasing shell 124, the bottom end of which is engageable with the outer rim 116. Joined to the upper end of the shell 124 is an internal shell 125 having retaining fingers 126 which engage the inner rim 119 to secure the dispenser housing 123 in place. The internal shell 125 is provided a collar 127, which is screwthreaded internally.

The collar 127 receives an externally screwthreaded body 128 having a flared outer portion 129 and a depending tubular stem 130 fitting over the stem 122 of the outlet valve 120 and, when the fingers 126 engage the inner rim 119, the stem 130 holds the outlet valve 120 in its open position, thus actuating the dispenser. Stem 130 is provided with an inlet passage 131 which is enlarged at its upper or outer end to receive a flow control body 132. Above the flow control body 132 the valve body is further enlarged internally to receive a seal disk 133 overlying the flow control body 132 and underlying a diaphram valve 134. Overlying the diaphram valve is a valve retainer ring 135 having a central outlet 136. The periphery of the diaphram valve is suitably retained by confronting annular ribs.

Formed between the flow control body 132 and the diaphram valve 134 is an accumulator region which includes a lower accumulator chamber or sub-region 137 at the underside of the seal disk 133 and an upper accumulator chamber or sub-region 138 between the disk 133 and diaphram valve 134 and connecting passages 139. The diaphram valve 134 is provided with a discharge orifice 140 and the seal disk 133 is provided with a valve seat 141.

The embodiment here illustrated is intended primarily for the discharge of minute quantities of aerosol, discharge taking place over a relatively short interval. Because the discharge interval is relatively short the preferred sequence of gas-liquid-gas flow is not required.

It will be noted that the outlet valve 120 of the conventional aerosol container 115 is used to perform the function of the screwthread actuator 27 shown in FIG. 2, and other embodiments; that is, when the outlet valve 120 is opened product flow to the accumulator is initiated and will eventually "actuate" the snap diaphram valve.

Figure 31:
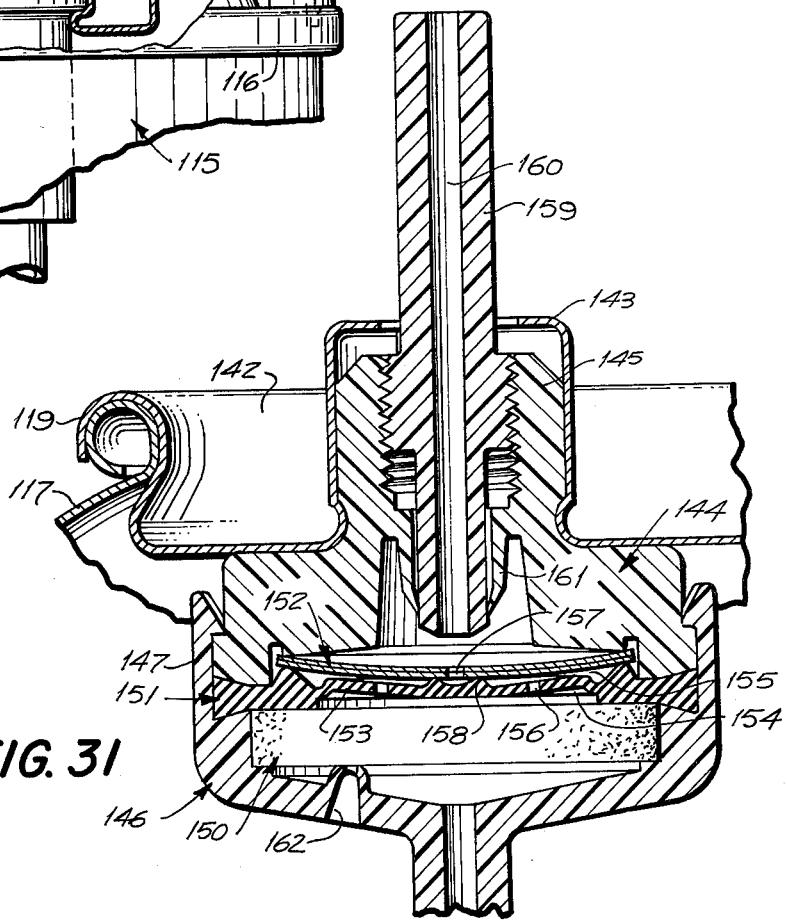
FIG. 31 is a fragmentary longitudinal sectional view showing a further embodiment of the unattended aerosol dispenser.

Referring to FIG. 31, the unattended aerosol dispenser here illustrated is intended for use with an aerosol container such as shown in FIG. 30, which is conventional, except for a modified central end member 142 which is received in the peripheral end member 117. The end member 142 is provided with a centrally disposed outward directed sleeve 143. An upper valve body 144 is provided which has a central boss 145, received and sealed in the central sleeve 143. The inner end of the upper valve body 144 confronts a lower cupped valve body 146 attached thereto by retainer fingers 147. The lower valve body 146 is provided with a lower end 148 which is closed except for an inlet tube 149.

Received in the lower valve body 146 is a flow control body 150. Interposed between the bodies is a seal disk 151. Disposed within the upper valve body 144 and confronting the seal disk is a diaphram valve 152. The periphery of the diaphram valve 152 is approximately fitted between supporting lips. The central portion of the seal disk 151 forms a flexible diaphram 153 which moves with the diaphram valve until snap action occurs in a manner previously described. Between the flow control body 150 and the diaphram valve 152 is an accumulator region including lower accumulator chamber or sub-region 154 between the control body 150 and seal disk 151, an upper accumulator chamber or sub-region 155 between the seal disk 151 and the diaphram valve 152 and connecting passages 156. The diaphram valve is provided with a central discharge orifice 157 and the center of the seal disk 151 is provided with a valve seat 158.

The central boss 145 of the upper valve body 144 is internally screwthreaded and receives an actuator stem 159 having a central discharge passage 160. The inner end of the actuator stem is provided with a sealing lip 161. The actuator stem 159 axially adjustable between the retracted position shown clearing the diaphram valve 152 and an extended position, not shown engaging the valve to maintain the valve contact with the valve seat 158.

Figure 12:
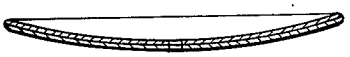
FIG. 12 is a transverse sectional view of a snap action valve disk which may be substituted for the valve disks shown in the various embodiments of the dispenser.

If the product and propellent are in separate fluid phases in the container resulting in insufficient propellent being provided via the dip tube, the lower end of the valve body 144 may be provided with a vapor tap 162 as previously described in connection with other embodiments. The diaphram valve 152, in FIG. 31 is illustrated as being bimetallic or may be formed of other laminated material which is temperature sensitive so that the diaphram valve 152 may compensate for temperature change. The temperature compensating valve, as also indicated in FIG. 12, may be imployed in the other embodiments of the unattended aerosol dispenser.

As the range of products and propellents which may be suitable for unattended intermittent discharge as well as the optimum discharge and time spacing between discharge may vary substantially, the size and porosity as well as the material from which the flow control body 5 as shown in FIG. 2 or as shown in the other embodiments may vary substantially. However, there are certain properties which are essential in all embodiments, namely:

1. For a given product the accumulation period should be capable of reproduction; that is, once an accumulation period has been established, it should be possible to produce a large quantity of dispensers without material variation in the accumulation period so that assuming the use of containers of a given size the total discharge period will remain essentially constant.

2. While the volume discharged at the end of each accumulation period is determined by the size of the accumulator region which may differ for different products, the volume of the accumulator region is necessarily small in comparison to the volume of the container; for example, but not limitation, a cubic centimeter or less.

For purposes of test a flow control body was formed of sintered metal having a maximum pore size of 0.2 microns, and made ⅜ in. (9.525mm) in diameter and ⅛ in. (3.175mm) thick. As the thickness of 3.175mm equals 3,175 microns, the minimum length of a pore passage through flow control body was 15,875 to 1. Actually the average pore passage was longer than this ratio as each pore passage was tortuous.

The outlet side of the flow control body was sealed by a rubber gasket except for an opening 0.010 in. (0.254mm) in diameter. The flow control body was inserted in an embodiment of the dispenser essentially the same as FIG. 7 and connected with an aerosol container having a capacity for approximately 300 grams of product and propellent. For test the product was an air freshener, known under the trademark LYSOL and the propellent was believed to be a fluorocarbon. The container had an initial pressure of approximately 75 pounds per square inch (5.27kg $cm^2$). The snap action valve was designed to open at about 40 pounds per square inch (2.81kg $cm^2$) and closed at about 20 pounds per square inch (1.40kg $cm^2$).

The dispenser discharged the contents of the container in approximately 30 days. The discharge occured each 18 minutes with a variation of approximately 2 minutes. The average duration of the discharge period comprising the gas-liquid-gas phases was less then 1 second.

If the pore size were increased to 0.4 microns or if the outlet were increased to 0.02 in. (1.016mm) the rate of discharge would increase fourfold; that is, the operating period would be 7 days.

While the material selected for test was sintered stainless steel, most other metals may be used as it is, assuming lack of chemical or solvent reaction, the number and physical dimensions of the pores which determines the discharge rate. Also most ceramic materials, many plastic materials, as well as various fibers formed of paper, cloth, animal or glass are suitable if compatable with the propellent and product.

Figure 27:
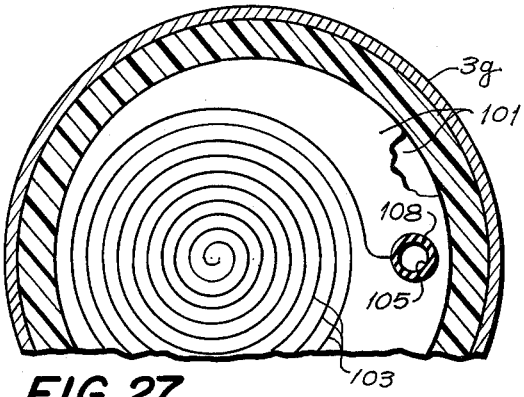
FIG. 27 is a sectional view taken through 27—27 of FIG. 26 indicating one of the labyrinth passages diagrammatically.

In a further test, disks were used similar to those indicated in FIG. 27. These were arranged to form a flow helical path 80 in. (2.meters) with a bore of 0.006 in. (0.15mm) by 0.003 in. (0.075mm). This path passed 124 grams in 48 hours or 2.58 grams per hour. A second test was made using a helical bore of the same length and cross-section as the previsous test, but provided with opposing vortices as shown in FIG. 29, the flow was 62 grams in 48 hours, or 1.29 grams per hour. Both tests used a 70 pound per square inch (4.92kg $cm^2$) pressure at an ambient temperature of 70° F (21.1° C).

While the various embodiments are indicated as operative in an upright position; that is, with the dispenser at the top of the aerosol container, they may be arranged for operation in an inverted position. In this case the initial discharge will be liquid which has settled at the bottom of the accumulator region, followed by a final gaseous discharge due to the collision of propellent in a gaseous phase under the flow control body. The presence of the upward extension to passage 11 will cause some entrapment of the liquid phase component; however, if the accumulating period is substantial some further change to gaseous phase will occur. Such entrapment may be avoided by omitting the extension and providing a U-bend in the passage 11.

It should be noted that the term "aerosol", as herein used, is intended to mean the product-propellent mixture whether either components are in the gaseous or liquid phase. Also the terms "tortuous" and "labyrinth" are used interchangeably; that is, either term includes the passages in the porous body shown in FIGS. 1 through 25, 30 and 31 or the passages in the laminated stack, shown in FIGS. 26 through 29.

For purposes of indicating the wide variety of uses of the intermittent unattended aerosol dispenser, reference is made to the accompanying Table which the various arrangements listed are intended to be illustrative of other embodiments of the invention.

TABLE I

| | PRODUCT | | | |
|---|---|---|---|---|
| | TYPE OF PRODUCT | CONTAINER SIZE IN OZ., ESTIMATED DURATION OF DISCHARGE IN DAYS | CHARACTERISTICS OF LIQUID PHASE (S) | AV. PRES. PSIG. (AMBIENT COND.) |
| 1. | Air Freshener | 7/30 | One phase - solution of alcohol, water and propellent | 40 |
| 2. | Air Freshener | 14/60 | Two phases - comprising propellent floating on aqueous phase | 46 |
| 3. | Disinfectant | 7/30 | Solution | 60 |
| 4. | Pesticide | 16/200 | Two phases - comprising propellent floating on water in oil emulsion | 44 |
| 5. | Mildewcide | 16/180 | Solution | 70 |
| 6. | Lubricant/Rust preventive | 21/30 | One phase - propellent and lubricant | 30 |
| 7. | Professional strength pesticide | 16/200 | Two phases | 44 |
| 8. | Sterlized water | 16/10 | Two phases - comprising propellent floating on aqueous phase | 30 |
| 9. | Repellent | 24/15 | Solution of propellent alcohol water and active | 70 |

| | ACCUMULATOR MEANS | | | |
|---|---|---|---|---|
| | TYPE OF PROD. FLOW CONTROL MEANS | MEAN RATE OF PROD. FLOW INTO ACCUMULATOR IN G/CYCLE | CAPACITY OF ACCUMULATOR IN GRAMS | SEALING MEANS |
| 1. | Ceramic | .005 | 20.01 | Deformable, thermo- |

TABLE I-continued

| | | | | |
|---|---|---|---|---|
| | | | | plastic member with limited travel |
| 2. | Water proof paper | .001 (gaseous propellent flow approx. .3 cc/min.) | .02 (includes propellent vapor) | Rigid reinforced plastic with compensating resilient valve seal |
| 3. | Plastic fibres | .005 | .01 | Stationary thermoplastic with no travel with compensating resilient valve seal |
| 4. | Sintered metal | .005 (gaseous propellent flow approx. .14 cc) | .001 (includes propellent vapor) | Stationary thermo setting plastic, provided with rubber valve seal |
| 5. | Leather | .005 | .01 | Deformable, plastic member with limited travel |
| 6. | Cotton fiber | .02 | .2 | Deformable, plastic with limited travel |
| 7. | Sintered metal | .001 (gaseous .001 (includes propellent flow approx. .14 cc) | Deformable, plastic propellent vapor) | with limited travel |
| 8. | Ceramic | .15 | .3 | Stationary plastic with no travel |
| 9. | Cotton. .2 | .4 | Deformable, plastic | with rubber seal |

| | SNAP VALVE MEANS | | | SPRAY CHARACTERISTICS | |
|---|---|---|---|---|---|
| | TYPE | MEAN DISC. PRESS. PSIG. | MEAN RESEAL PRESS. PSIG. | SPRAY PROFILE | OBSERVATIONS |
| 1. | Biased metal disc | 38–40 | 10–15 | Sharp space spray, with high concentration of 10–30 micron particles little drooling, no noticeable product full out | Effective as mood setting in rooms from 1000 to 10,000 cu. ft. Concentration of fragrance reduced when used in closet as clothes freshener and moth proofer. Effective in commercial eating outlets when fragrances such as fresh-baked bread is used. |
| 2. | Laminate plastic snap spring with thermal compensating feature | 43–46 | 12–16 | Sharp space spray, with 90–95% of the particles at 10–20 microns, free from drooling | Functional odor eliminator especially in areas where there are pets, cigar smoke, food odors. Used with marked success in public restrooms. |
| 3. | Resilient bellows with mechanical biasing | 57–60 | 15–20 | Crisp surface spray that wets the area within 15 ft. radius of container | Effective under sinks, around toilets and garbage cans. Control odor causing bacteria. Used in sick rooms to control Flu & virus. |
| 4. | Biased metal spring | 41–44 | 8–12 | Sharp space spray, with high concentration of 10–20 micron particles. No noticeable sputtering or drooling | Adequate knockdown of flying insects, but most effective on crawling insects and repelling most insects in spaces ranging from 1,000 to 10,000 cu. ft. |
| 5. | Biased metal disc | 65–70 | 16–20 | Sharp space spray | Controls mildew fungus and other microflora in spaces from 1000 to about 15,000 cu. ft. |
| 6. | Biased metal | 28–30 | 8–10 | Surface spray, fine mist particles wet the area within 5 ft. radius of container. | Effective in periodically lubricating moving parts in a production/distribution line. Effective in maintaining machine tools free from rust during shipment. |
| 7. | Biased metal disc | 41–41 | 8–12 | Space spray with high concentration of 10–30 micron particles. | A threefold increase in actives used - excellent control of termites when placed in crawl space |
| 8. | Laminated plastic with thermal compensating feature | 27–31 | 8–10 | Space spray, essentially all particles less than 20 microns. | Used in burn control rooms and incubators in hospital - as a source of water vapor. Free from contamination. |
| 9. | Laminated plastic with thermal compensating feature | 65–70 | 10–15 | Space spray | Used around patios, shrubs, and effective in repelling most insects effectiveness diminishes rapidly under windy conditions. |

While perferred forms and arrangements of parts have been shown in illustrating the invention, it is to be clearly understood that various changes in details and arrangements of parts may be made without departing from the spirit of the invention.

I claim:

1. A dispenser for effecting intermittent discharge of an aerosol including product and propellent from an aerosol container, said dispenser means comprising:

a. means defining an accumulator region disposed at one end of the container and having an entrance end communicating with the interior of the container to receive an aerosol therefrom;

b. a snap action means including a diaphram forming a wall of the accumulator region and having a valve seat element, an opposing wall of the accumulator region having a mating valve seat element, said valve seat elements being in fluid sealing relationship when the snap action valve means is closed;

c. means forming a discharge passage from the accumulator region including an entrance end surrounded by one of the valve seats;

d. and a flow control body fixed between the entrance end of the accumulator region and the interior of the container, said flow control body including an elongated tortuous or labyrinth path means to produce a gradual pressure drop as the product and propellent pass therethrough from the interior of the container into the accumulator region, to volatilize at least a portion of the aerosol to form a gaseous and a liquid phase, which phases pass into the accumulator region for distribution in the accumulator region during gradual rise in pressure therein until the valve seats open for flow through the discharge passage.

2. An intermittent dispenser, as defined in claim 1, which further comprises:

a. a manually operated actuator for adjusting the spacing between the valve seat elements when open to determine the flow rate through the discharge passageway and to determine the lower pressure at which the valve elements close, thereby adjusting the volume and duration of each period of flow;

b. said actuator being adjustable to shut off intermittent flow.

3. An intermittent dispenser as defined in claim 1, wherein:

a. the flow control body is disposed at the bottom side of the accumulator chamber and the communication between the accumulator chamber and valve chamber includes a passage having a lower end in proximity to the flow control body, whereby on accumulation of aerosol at the bottom of the accumulator chamber, the liquid phase initially isolates the gaseous phase from communication with the valve chamber, to cause a liquid phase discharge followed by a gaseous phase discharge enhanced by the initially trapped gaseous phase in the accumulation chamber.

4. An intermittent dispenser as defined in claim 1, wherein:

a. the snap action element is a valve diaphram forming one of the seat elements at its center, and the other seat element is movable therewith to maintain closed contact until snap action occurs.

5. An intermittent dispenser as defined in claim 1, wherein:

a. the snap action means is a valve diaphram having a central relatively movable means including one of the seat elements, the relatively movable means maintaining engagement with the other seat element until snap action occurs.

6. An intermittent dispenser as defined in claim 1, wherein:

a. the snap action element includes a flexible diaphram having one of the seat elements, a snap spring at the opposite side of the diaphram isolated from the aerosol.

7. An intermittent dispenser as defined in claim 1, wherein:

a. the supply passage, flow control body, and accumulator chamber are arranged as a first unit permanently incorporated in the aerosol container;

b. the valve chamber, snap action means and discharge passageway are arranged as a second unit;

c. and separable connector means join the first and second units.

8. An intermittent dispenser as defined in claim 1, which further comprises:

a. a manually operated means bypassing the flow control body for effecting manually controlled discharge of the aerosol without disturbing the rate of flow through the flow control body.

9. An intermittent dispenser, as defined in claim 1, which further comprises:

a. means for varyng the rate of flow of aerosol through the flow control body.

10. An intermittent dispenser, as defined in claim 1, wherein:

a. the flow control body is a porous body having a multiplicity of labyrinth passages therethrough.

11. An intermittent dispenser, as defined in claim 1, wherein a. the flow control body is a porous body having a multiplicity of labyrinth passages therethrough, the entrance ends of the passages are distributed over a substantial portion of the surface of the porous body and the exit ends of the passages are less in number and confined to a preselected reduced portion of the surface of the porous body, whereby the effective combined area of the labyrinth passages decreases toward the exit ends of the labyrinth passages.

12. An intermittent dispenser, as defined in claim 11, wherein:

a. means is provided to vary the relative number of labyrinth passage entrance and exit ends thereby to vary the rate of discharge of aerosol therefrom.

13. An intermittent dispenser, as defined in claim 1, wherein:

a. the flow control body includes a multiplicity of laminations having preformed labyrinths thereon.

14. An intermittent dispenser, as defined in claim 1, wherein the flow control body includes:

a. a multiplicity of laminations having preformed labyrinth passages thereon arranged in series;

b. and a manually adjustable control member for varying the effective length of the labyrinth passages, thereby to vary the rate of discharge from the flow control body.

15. An intermittent dispenser as defined in claim 14, wherein:

a. said manual control member is further movable to shut off flow from the flow control body and also further movable to bypass the labyrinth passages and override intermittent operation of the valve means.

16. An intermittent dispenser, as defined in claim 1, for aerosols which undergo separation of product and propellent, the propellent collecting at the top of the container, wherein:

a. the supply passageway includes a dip tube having an entrance end at the bottom portion of the container;

b. a propellent passage bypasses the dip tube and communicates between the top of the container and the flow control body to supplement the supply of aerosol from the dip tube and increase the proportion of gaseous propellent in the accumulator chamber.

17. An intermittent dispenser, as defined in claim 1, for use with conventional aerosol containers having a conventional aerosol outlet and dip tube, wherein the dispenser further comprises:

a. a separable coupling for attaching the supply passageway to the aerosol outlet and dip tube; b. and attachment elements for removable engagement with the aerosol container.

18. Means for effecting intermittent discharge of an aerosol including a product and a propellent from an aerosol container having a dip tube extending from the bottom between the ends to the top end of the container, said means comprising:

a. means defining an aerosol accumulator region disposed at the upper end of the container, including a lower sub-region and an upper sub-region and a connecting sub-region;

b. a snap action valve means including a diaphram forming the upper wall of the upper sub-region and having a valve seat disposed thereon, the bottom opposing wall of the upper sub-region having a mating valve seat;

c. means forming a discharge passage including an entrance end surrounded by one of the valve seats;

d. a flow control body at the lower sub-region connected to the upper end of the dip tube, said flow control body including a tortuous path to produce a gradual pressure drop in the aerosol passing from the dip tube into the accumulator region thereby volatilizing at least a portion of the aerosol forming a gaseous and a liquid phase, which phases pass into the accumulator region for distribution therein and gradual rise in pressure therein until the valve seats open for flow through the discharge passage.

19. An intermittent dispenser for a pressurized aerosol container provided with a dispensing tube having a discharge end, said dispenser comprising:

a. a flow control means having a lower side for receiving pressurized aerosol from the dispensing tube, and including elongated restricted passage means dimensioned to produce a gradual pressure drop in the aerosol passing upwardly through the flow control means, thereby to cause at least partial separation of the aerosol into its liquid and gaseous components for upward discharge therefrom;

b. an accumulator means defining a first chamber having fixed walls, a contiguous second chamber having at least one movable wall, and a connecting passage, the first chamber having a lower region for collecting the liquid component discharged from the flow control means thereunder, and an upper region for collecting the gaseous component discharged from the flow control means, and the connecting passage having an entrance end in the lower region of the first chamber;

c. valve means including the movable wall of the second chamber, and a pair of valve seats carried by the movable wall and the opposing wall of the second chamber, said movable wall having initial slow movement in proportion to increase in pressure in the accumulator means, and a final snap movement when the pressure in the accumulator means reaches a selected amount, said slow movement of the movable wall;

d. and an aerosol discharge passage having an entrance opening within one of the valve seats for discharging the contents of the lower and upper regions of the first chamber in sequence thereby to discharge the liquid component followed by discharge of a gaseous component to sweep away any residual liquid component from the discharge passage.

20. Means for effecting intermittent dispensing of an aerosol from an aerosol ccontainer, comprising:

a. a flow control body for receiving an aerosol from the aerosol container, the flow control body including an elongated labyrinth path to produce a gradual pressure drop in the aerosol passing therethrough to volatilize at least a portion of the aerosol and cause discharge of liquid and gaseous components from the flow control body;

b. means defining a discharge passageway;

c. means defining an accumulator region between the discharge passageway and the flow control body, the accumulator region including a first sub-region for accumulating a gaseous component, a second sub-region for accumulating a liquid component, and a third sub-region for accumulating a gaseous component;

d. and valve means forming confronting wall portions of the first sub-region responsive to a predetermined high pressure in the first accumulator sub-region to open the discharge passageway thereby to cause discharge from said sub-regions in sequence whereby the initial discharge is gaseous, followed by a liquid discharge followed by a final gaseous discharge, said valve means closing in response to a predetermined low pressure in said accumulator region.

21. An intermittent dispenser, as defined in claim 20, which further comprises:

a. manually operated means engageable with the valve means to shut off flow through the discharge passageway;

b. said manually operable means also being adjustable to regulate the rate of flow through the discharge passageway and to regulate the low pressure at which the valve means closes.

22. An intermittent dispensing means as defined in claim 20, wherein:

a. the second and third sub-regions are formed in a common chamber having a lower side exposed to the flow control means, and defining the second region, the upper portion of the chamber defining the third region;

b. and a depending tubular element dips into liquid accumulating in the second region and communicates with the first region.

23. An intermittent dispensing means, as defined in claim 20, wherein:

a. the valve means includes a snap action element and means is provided for maintaining the valve means closed until snap action of the element occurs.

24. An intermittent dispensing means, as defined in claim 20, wherein:

a. the valve means includes a snap action diaphram and a bellows diaphram, the bellows diaphram maintaining the valve means closed until snap action occurs.

25. An intermittent dispensing means, as defined in claim 20, wherein:

a. the valve means includes a flexible diaphram, a valve seat confronting the diaphram, and a snap spring at the opposite side of the diaphram isolated from the aerosol.

26. An intermittent dispensing means, as defined in claim 20, wherein:

a. the supply passage, flow control means, second and third sub-regions are arranged as a disposable unit permanently attached to the aerosol container for disposal therewith;

b. and separable elements connect the first subregion to the disposable unit to permit reuse of the valve means.

27. An intermittent dispenser, as defined in claim 20, which further comprises:

a. a manually operated means bypassing the flow control means for effecting manually controlled discharge of the aerosol.

28. An intermittent dispenser as defined in claim 20, which further comprises:

a. means for varying the rate of flow through the flow control body.

29. An intermittent dispenser, as defined in claim 20, wherein:

a. the flow control body is provided with a multiplicity of labyrinth passages therethrough.

30. An intermittent dispenser, as defined in claim 20, wherein:

a. the flow control body is provided with a multiplicity of labryinth passages therethrough, the entrance ends being distributed over a substantial portion of the surface of the porous body, and exit ends confined to a preselected reduced portion of the surface of the porous body, whereby the effective combined area of the labyrinth passages decreases toward the exit ends of the labyrinth passages.

31. An intermittent dispenser, as defined in claim 30, wherein:

a. means is provided to vary the relative combined areas of the entrance and exit ends of the labyrinth passages to vary the rate of discharge of aerosol therefrom.

32. An intermittent dispenser, as defined in claim 20, wherein:

a. the flow control body includes a multiplicity of laminations having preformed labyrinth passages thereon.

33. An intermittent dispenser, as defined in claim 20, wherein:

a. the flow control body includes a multiplicity of laminations having preformed labyrinth passages thereon arranged in series;

b. and a manually adjustable control member is provided to vary the effective length of the labyrinth passages thereby to vary the rate of discharge from the flow control body.

34. An intermittent dispenser, as defined in claim 32, wherein:

a. said manual control member is further movable to shut off flow from the flow control body and also further movable to bypass the labyrinth passages thereby to override intermittent operation of the valve means.

35. An intermittent dispenser, as defined in claim 20, for aerosols which undergo separation of product and propellent, the propellent collecting at the top of the container, wherein:

a. the supply passageway includes a dip tube having an entrance end at the bottom portion of the container;

b. a propellent passage extends from the top of the container to the flow control body for delivery of supplementary gaseous fluid to the third region.

36. An intermittent dispenser, as defined in claim 20, wherein the aerosol container has a conventional aerosol outlet and the dispenser further comprises:

a. means for removable attachment to the aerosol container and its aerosol outlet.

37. Means for effecting intermittent dispensing of an aerosol from an aerosol container, comprising:

a. means defining a supply passageway for the contents of an aerosol container;

b. a flow control body having a lower intake side for receiving the flow from the supply passageway and an upper discharge side, the flow control body having labyrinth passage means therethrough of such size and length as to cause separation of the aerosol into gaseous and liquid components in the course of flow therethrough as well as to discharge a small volume over a long time period;

c. an accumulator chamber having a bottom end for receiving the aerosol components and an upwardly extending connector passage;

d. a valve chamber above the accumulator chamber having a lower side communicating with the connector passage;

e. a pressure responsive snap action diaphram valve forming the upper side of the valve chamber, the diaphram valve and lower wall of the valve chamber having mating valve seats;

f. a discharge passage having an entrance end surrounded by one of the valve seats;

g. said diaphram valve and the valve seats being movable in unison therewith in response to pressure increase in the accumulator chamber resulting from flow of the liquid and gaseous aerosol components into the accumulator chamber;

h. said diaphram valve being arranged to cause its valve seat to snap open at a preselected pressure in the valve and accumulator chambers to cause flow through the discharge passageway accompanied by corresponding drop in pressure in the valve and accumulator chambers;

i. said diaphram valve being arranged to cause its valve seat to snap closed at a preselected lower pressure to terminate flow through the discharge passageway thereby to permit repressuring of the valve and accumulator chambers, and reopening of the discharge passageway;

j. said connector passage including a portion extending downwardly into the accumulator chamber to form an entrance end adjacent the bottom of the accumulator chamber whereby on accumulation of the liquid and gaseous components therein the liquid component covers the entrance end of the outlet and traps the gaseous component in the accumulator chamber above the liquid component thereby to cause, on opening of the discharge passageway, a discharge of the liquid component from the accumulator chamber followed by a final discharge of the previously trapped gaseous component thereby to flush the discharge passageway free of the liquid component.

38. An intermittent aerosol dispensing means as defined in claim 37, wherein:

a. the flow control body is a porous body and the labyrinth passage means constitutes a multiplicity of labyrinth passages through the porous body so arranged that passage means entrance ends materially exceeds the passage means exit ends, thereby to effect progressive restriction of flow.

39. An intermittent aerosol dispensing means as defined in claim 38, wherein:

a. means is provided to vary the relative number of passage inlet and outlet ends thereby to vary the rate of flow into the accumulator chamber, and the period between discharge of aerosol.

40. An intermittent aerosol dispensing means, as defined in claim 37, wherein the flow control body includes;

a. a multiplicity of laminations having preformed labyrinth passages arranged in series;

b. and a manually operable control member for varying the effective length of the labyrinth passages, thereby to vary the rate of seepage into the accumulator chamber and the period between discharge of aerosol.

41. An intermittent aerosol dispensing means, as defined in claim 37, wherein:

a. the discharge passageway extends axially through the diaphram valve.

42. An intermittent aerosol dispensing means, as defined in claim 37, wherein:

a. the discharge passageway extends laterally between the valve and accumulator chambers.

43. Means for effecting intermittent dispensing of an aerosol from an aerosol container, comprising:

a. a flow control body for receiving an aerosol from the aerosol container, the flow control body including an elongated tortuous path to produce a gradual pressure drop in the aerosol passing therethrough to volatilize at least a portion of the aerosol and cause discharge of liquid and gaseous components from the flow control body at a low flow rate;

b. means defining a discharge passageway;

c. means defining an accumulator region between the discharge passageway and the flow control body;

d. a valve means forming confronting wall portions of the accumulator region for controlling flow therefrom into the discharge passageway, the valve means including an externally accessible portion;

e. and an externally disposed maually operable means engageable with the valve means to close the discharge passageway and retractable therefrom to permit preselected movement of the valve means.

* * * * *